US006528944B1

(12) United States Patent
Kishi et al.

(10) Patent No.: US 6,528,944 B1
(45) Date of Patent: Mar. 4, 2003

(54) FLAT PANEL DISPLAY WITH REDUCED DISPLAY DEAD SPACE

(75) Inventors: Hisatoshi Kishi, Tokyo (JP); Kazuhisa Hemmi, Tokyo (JP); Hironobu Arimoto, Tokyo (JP); Atsushi Ito, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/262,090

(22) Filed: Mar. 4, 1999

(30) Foreign Application Priority Data

Sep. 29, 1998 (JP) ..... 10-275195

(51) Int. Cl.[7] ..... H01J 17/49

(52) U.S. Cl. ..... 313/582; 313/495; 313/496; 313/581; 313/24; 313/25

(58) Field of Search ..... 313/495, 496, 313/497, 582, 581; 445/24, 25, 23

(56) References Cited

U.S. PATENT DOCUMENTS

| | | | | |
|---|---|---|---|---|
| 3,975,725 A | * | 8/1976 | Ogle | 313/582 |
| 4,139,250 A | * | 2/1979 | Jacobs et al. | 445/25 |
| 4,389,277 A | * | 6/1983 | deVries | 445/24 |
| 4,853,590 A | * | 8/1989 | Andreadakis | 313/485 |
| 5,214,521 A | * | 5/1993 | Kwon et al. | 359/54 |
| 5,239,228 A | * | 8/1993 | Taniguchi et al. | 313/512 |
| 5,493,175 A | * | 2/1996 | Kani | 313/584 |
| 5,626,772 A | * | 5/1997 | Bongaerts et al. | 428/163 |
| 5,959,403 A | * | 9/1999 | Lee | 313/582 |

FOREIGN PATENT DOCUMENTS

| | | |
|---|---|---|
| EP | 0 580 868 A | 12/1994 |
| JP | 59110946 | 7/1984 |
| JP | 290192 | 3/1990 |
| JP | 394751 | 9/1991 |
| JP | 513003 | 1/1993 |
| WO | WO 96/14651 | 5/1996 |
| WO | 9844531 | 10/1998 |

* cited by examiner

*Primary Examiner*—Nimeshkumar D. Patel
*Assistant Examiner*—Mariceli Santiago
(74) *Attorney, Agent, or Firm*—Rothwell, Figg, Ernst & Manbeck

(57) ABSTRACT

A flat display panel is provided which can improve the reliability of the contact portion where a flat plate and a back plate are bonded together and can suppress the display dead space. Recessed portions 52 are formed in a glass substrate 60 so that a sealing wall 63 is formed along the outer fringe of a back plate 61. The front plate 54 includes a protrusion 59 protruding outward from the sealing wall 63 on the outer fringe portion thereof. The contact portion between the front plate 54 and the back plate 61 is sealed by depositing fritted glass 62 onto the corner portion defined by the protrusion 59 and the side surface of the back plate 61. In order to improve the sealing effect, the fritted glass 62 is inserted into the gap at the bonding portion. The groove 64 is formed on the top surface of the sealing wall 63 to prevent the fritted glass 62 from intruding in to the discharge space.

2 Claims, 3 Drawing Sheets

FLAT PANEL DISPLAY WITH REDUCED DISPLAY DEAD SPACE

BACKGROUND OF THE INVENTION

1. Field of the Invention

The present invention relates to a flat display panel being a flat display device that displays characters, graphics and images using light emission produced by ionized gas, and particularly to a technique of sealing a structure formed of a front plate and a back plate at the side surfaces thereof.

2. Description of the Prior Art

Conventional flat display panels are referred to as plasma display panels. This type of display panel is disclosed in, for example, Japanese Patent Laid-open Publication No. Hei 2-90192 and Japanese Utility Model Laid-open Publication No. Hei 3-94751. In the structure, two substrates each having plural linear electrodes formed thereon are disposed in parallel so as to confront each other. The linear electrodes formed on one substrate and the linear electrodes formed on the other substrate are disposed in a matrix form. Gas discharges occur at intersections between the linear electrodes on one substrate and the linear electrodes on the other substrate. The gap between the fringe portion of the front plate and the fringe portion of the back plate is sealed with a bonding agent such as a fritted glass. The space between the front plate and the back plate is filled with a discharge gas.

In the conventional flat display panel, voltages are respectively applied to the ends of the linear electrodes leading out of the side end surfaces of the plate. The electrodes arranged on the front plate are formed of a transparent electrode material such as ITO so as to pass through the emitted light produced by a gas discharge. However, the transparent electrode material has a considerably large resistance value because of its low electric conductivity and because of the narrowed and elongated linear electrodes resulting from the trend toward high-resolution and large-sized screens. This causes the problem that as a voltage pulse applied to an end of a linear electrode propagates toward the middle portion of the linear electrode, it is attenuated. For that reason, using current fabrication methods, the conventional flat display is limited up to a screen size of 1 m×1 m.

With recent advances in the information-oriented society, there have been increasing demands for large-sized display screens. As one approach, it has been considered to obtain a large screen by arranging plural prior-art flat display panels side by side.

However, where a large screen is fabricated by arranging plural panels, a large gap between the display regions of neighbor panels causes a large dead space in the screen display, thus resulting in deteriorating the display quality. In order to solve such a problem, it has been considered to reduce the space for sealing the bonding portions between the side surfaces of two plates.

FIG. 1 is a cross sectional view schematically illustrating the end portion in the side sealed structure of a flat display panel disclosed in Japanese Patent Laid-open Publication No. Hei 5-13003. A front plate 11 is formed of a glass substrate 1, and transparent electrodes 2 and transparent dielectric layers 3 formed thereon. A back plate 21 is formed of a glass substrate 4, and metal electrodes 5, black dielectric layers 6 and spacer ribs 7 formed thereon. The front plate 11 and the back plate 21 are arranged in parallel. The open sides of the spaced-plate structure are sealed with a fritted paste.

As described above, the prior-art structure includes the spacer ribs 7 which maintain the gap between the front plate and the back plate to secure a discharge space. The spacer rib 7 is formed of, for example, a porous substance, not suitable for sealing, and is not used to seal the openings between the two plates. The thickness of the spacer rib 7 must be set to a value exceeding the total of the thickness of constituent elements formed on the glass substrate 1 and the thickness of the constituent elements formed on the glass substrate 4. Hence, the spacer rib 7 is formed of, for example, stacked films.

In the conventional flat display panel structure, the front plate and the back plate are spaced widely apart, and the opening area to be sealed with fritted glass 8 becomes large. The fritted glass 8 is in a paste state before its solidification through calcination. The fritted glass 8 is not supported in the opening area for sealing but holds its state by only its viscosity or surface tension against an external force such as gravity. The thickness of the fritted glass is prone to become uneven at the sealing portion. As a result, there has been the problem that the reliability of sealing cannot be secured in the conventional technique. If a large amount of fritted glass is used to avoid such a problem, the area of the front plate on which the fritted glass is rested become large. This means that the dead space cannot be reduced in arranging panels. A large amount of fritted grass contains a large amount of solvent, the large amount of solvent permeating from the opening between a front plate and a back plate will contaminate the discharge space.

Description of the Related Art

In the conventional flat display panel, two transparent insulating substrates are arranged in parallel so as to be spaced apart from each other. Plural linear discharge electrodes are arranged in parallel on each substrate. The linear electrodes on one substrate and the electrodes on the other substrate confront each other and are arranged in a matrix form. A partition wall defining a discharge space for each electrode is formed on the substrate. The display control is performed-by selecting the confronting electrodes arranged in a matrix form. As a result, the display control cannot be independently performed for each display cell. The above-mentioned structure leads to a thick flat display panel.

For that reason, it has been strongly desired to develop a flat display panel with a novel structure different from the conventional structure. The present applicant proposed a flat display panel with a new structure in the international application (PCT/JP98/01444) based on the Patent Cooperation Treaty. In this structure, recessed portions, each acting as a discharge space for a display cell, arranged in a matrix form are formed in the back plate. In the front plate, pairs of cell electrodes are formed on the regions confronting the recessed portions of the back plate. The front plate is disposed over the back plate. In the flat display panel, pin electrodes penetrate the back plate so that a voltage signal can be applied to a given spot of an electrode formed on the front plate. That is, this structure allows a voltage to be applied between a pair of cell electrodes corresponding to a display cell so that the display cells can be respectively display-controlled. Since the back plate has recessed portions each for a discharge space, it is not required to attach or stack partition walls partitioning discharge spaces on the substrate, as shown in the prior art. Hence, this feature allows the display panel to be thinned.

The flat display panel with this new structure differs from the conventional flat display panel using linear electrodes, in that cells can be respectively driven using pin electrodes. In other words, since cells are independently driven, a large screen can be easily divided into plural flat display panels. A large screen can be easily fabricated by arranging panels each smaller than the conventional flat display panel. Additionally, a panel having defect pixels can be easily replaced with a new one.

SUMMARY OF THE INVENTION

The objective of the invention is to provide a flat display panel with a novel structure in which the front panel is bonded with the back plate.

Further objective of the invention is to provide a structure that can solve the above-mentioned problems in the conventional flat display panel.

According to the present invention, the flat display panel comprises a front panel of a transparent glass substrate on which cell electrode pairs are arranged for pixels, and a back plate having recessed portions formed in a surface thereof, the recessed portions being positioned so as to confront the cell electrode pairs, the recessed portions each defining a discharge space, the back plate being placed over the front plate; the back plate having a sealing wall having a top surface of the back plate remaining outside a display region formed of the recessed portions; the front plate having a protrusion protruding outward from the outer fringe of the sealing wall; wherein a contact portion between the sealing wall and the front plate is sealed by depositing a bonding agent in a corner portion defined by the outer side surface of the sealing wall and the protrusion of the front plate, the corner portion being adjacent to the bonding portion.

In the flat display panel according to the present invention, at least the front plate or the back plate has a groove extending along the sealing wall in a plate surface region where the top surface of said sealing wall confronts the front plate.

The flat display panel according to the present invention further comprises a barrier for blocking the bonding agent on the outer fringe portion of the front plate.

According to the present invention, a flat panel display comprises a front panel of a transparent glass substrate on which cell electrode pairs are arranged for pixels; and a back plate having recessed portions formed in a surface thereof, the recessed portions being positioned so as to confront the cell electrode pairs, the recessed portions each defining a discharge space, the back plate being placed over the front plate; the back plate having a sealing wall having a top surface of the back plate remaining outside a display region formed of the recessed portions; wherein a contact portion between the sealing wall and the front plate is sealed by means of a bonding agent layer to be bonded on the outer side surface of a superposed structure of the front plate and the back plate as well as a band member to be securely bonded on the outer side surface of the superposed structure pressure-bonded to the bonding agent layer.

BRIEF DESCRIPTION OF THE DRAWINGS

This and other objects, features and advantages of the present invention will become more apparent upon a reading of the following detailed description and drawings, in which.

DESCRIPTION OF THE PREFERRED EMBODIMENTS

Next, preferred embodiments of the present invention will be described below with reference to the attached drawings.

Embodiment 1

Figure 2:
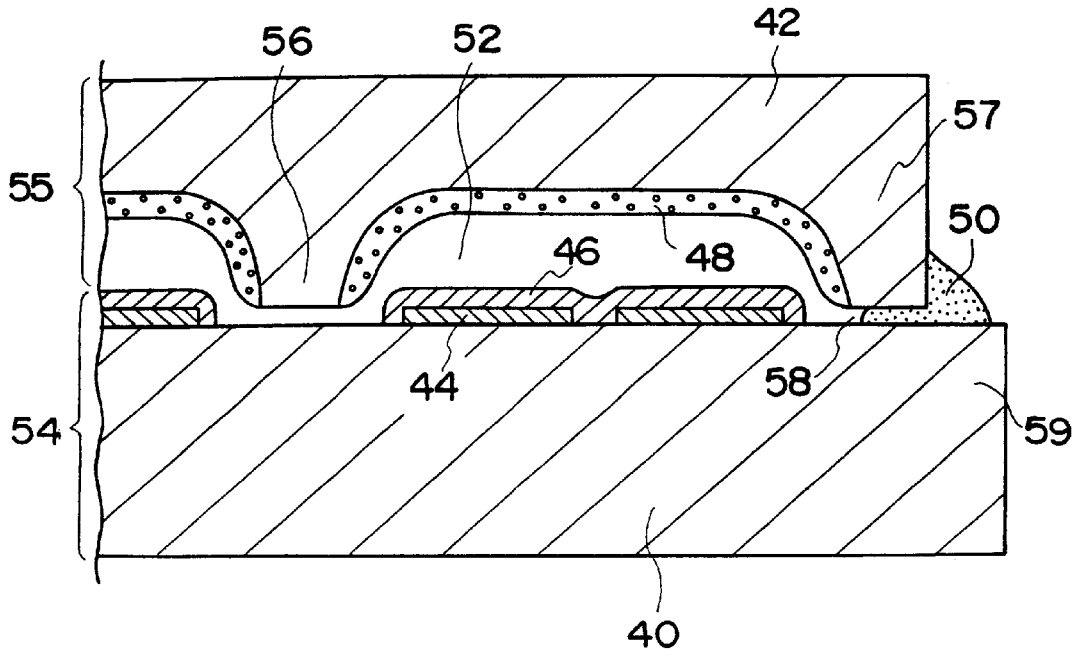
FIG. 2 is a cross-sectional view schematically illustrating the side end sealing structure of a novel flat display panel according to the first embodiment of the present invention.

FIG. 2 is a cross sectional view schematically illustrating a sealed side portion of a flat display panel with a novel structure according to the first embodiment of the present invention. This structure includes a transparent glass substrate 40 acting as a front plate and a glass substrate 42 acting as a back plate.

A transparent electrode layer is deposited on the back surface of the transparent glass substrate (facing the back plate) and then cell electrodes 44 are formed by patterning the electrode layer. In this flat display panel, a pair of cell electrodes 44 are disposed for a pixel or cell. A dielectric layer 46 is formed over the cell electrodes 44 to electrically insulate them.

Recessed portions 52 each called a cell for a pixel are formed in the glass substrate acting as the back plate. The cells are formed by depositing a mask layer on the surface of the glass substrate 42 and then sand-blasting the remaining regions except the mask region. Each recessed portion corresponds to a pixel and has a rectangular opening. A fluorescent layer 48 is coated on the inner surface of each recessed portion 52.

The front plate 54 including a transparent glass substrate 40 acting as a base substrate is placed over the back plate 55 including a glass substrate 42 acting as a base substrate so as to cause cell electrodes 44 to respectively confront recessed portions 52. The glass substrate 42 is disposed so as to be adjacent to the surface of the front plate. A fixed discharge space is defined over the cell electrode 44 by the recessed portion 52 of the glass substrate 42. A glow discharge occurs within the discharge space by applying a voltage between cell electrodes 44. The glow discharge emits ultraviolet rays which irradiate the fluorescent substance layer 48. The fluorescent light emitted from the fluorescent substance layer 48 passes through the area confronting the front plate 54 and is then emitted from the surface of the transparent glass substrate 40.

A partition wall 56 is the portion remained between the recessed portion 52 corresponding to each pixel. The partition wall 56 separates the discharge spaces of pixels from each other and allows the pixels to be respectively emitted. The partition wall has a notch which communicates gas between cells. The front plate 54 is combined with the back plate 55. The open sides of the two spaced plates are sealed (as described later). Then, the air is evacuated out of all the cells through the exhaust tube disposed at a portion of the intermediate structure. Then, Ne-Xe, for example, is injected into all the cells through the exhaust tube.

In this case, the recessed portions 52 are formed in only the surfaces of the back plate 55 corresponding to display areas. The surfaces of the glass substrate 42 surrounding the display areas are not sculptured in the sand-blasting. The glass surface with high evenness is left between the edge of the glass substrate 42 and the outer fringe pixel. The narrow portion is formed all over the outer periphery of the glass substrate 42 and acts as the sealing wall 57 which hermetically seals cells formed in the inner area of the glass substrate from the outside. The width of the top of the sealing wall 57 defining the gap between the outer cells and the edge of glass substrate 42 is, for example, about 0.25 mm. The dead space occupied by the end portion of the flat display panel can be suppressed by thinning the width of the sealing wall 57.

The gap between the top surface of the sealing wall 57, or the surface of the glass substrate 42, and the joint portion 58 of the front plate is as small as about 5 $\mu$m. The joint portion 58 is externally sealed with a sealing bonding agent such as fritted glass. The transparent glass substrate 40 has a protruding portion 59 protruding out from the outer periphery position of the sealing wall 57, or from the side surface of the glass substrate 42. In other words, the transparent glass substrate 40 is somewhat larger than the glass substrate 42. The fritted glass 50 seals are deposited at the corner defined by the top surface of the protruding portion 59 (corresponding to a back surface of the transparent glass substrate 40) and the outer side surface of the sealing wall 57 (corresponding to the side end surface of the glass substrate 42). The fritted glass paste invades into the gap at the joint portion 58. In such a situation, the fritted glass 50 is calcinated and solidified so that the open sides of the intermediate structure formed of the front paste 54 and the back plate 52 are hermetically sealed.

Figure 1:
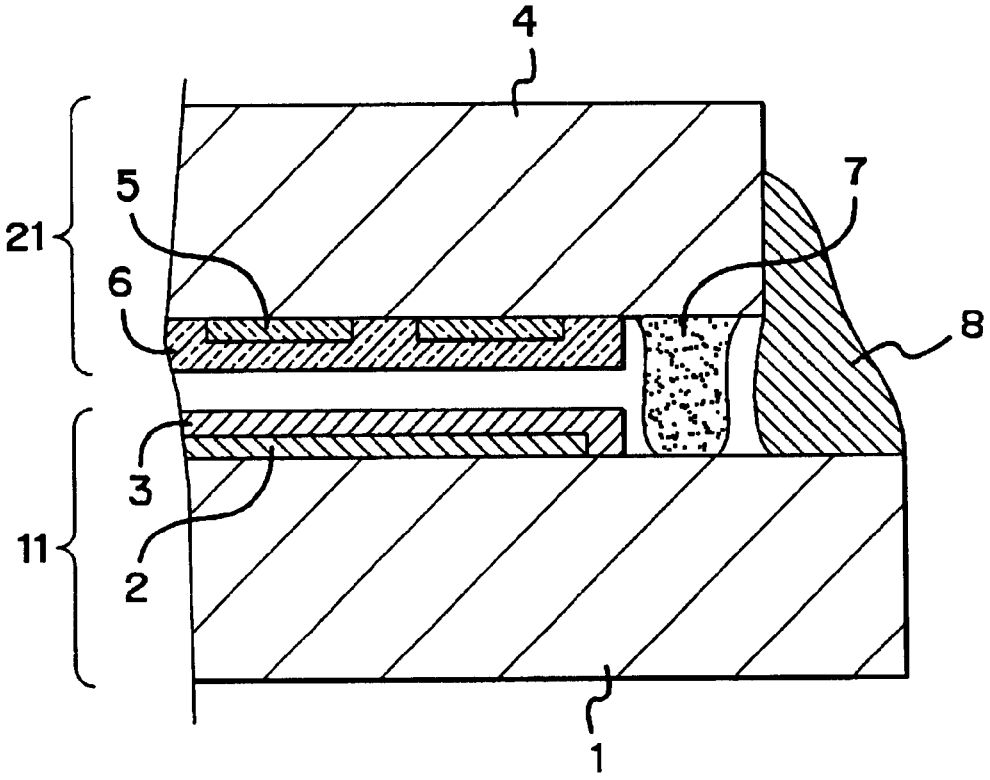
Fig. 1 PRIOR ART
FIG. 1 is a cross sectional view schematically illustrating the side end sealing structure of a conventional flat display panel.

In a structure differing from that shown in FIG. 1, the recessed portions 52 each acting as a cell formed in the glass substrate 42 can eliminate the spacer rib and reduce the gap between the front plate 54 and the back plate 55. The side walls of the recessed portions formed at the outer periphery work as the sealing wall 57. The sealing wall 57 being a part of the glass substrate 42 does not pass gas, unlike the porous spacer rib. Hence, the sealing is sufficiently accomplished simply by filling the vicinity of the narrowed joint portions 58 with the fritted glass 50. This means that excellent hermetic sealing can be maintained with a small amount of the fritted glass. Particularly, further improved hermetic sealing is established by penetrating the fritted glass paste into the middle area within the gap and filling the area with it. The small amount of fritted glass decreases the extent that the fritted glass protrudes out from the outer position of the sealing wall 57 at the protruding portion 59. As a result, the dead space between the flat display panels can be reduced. For example, the protrusion of the protruding portion 59 may be set to about 0.25 mm.

Furthermore, the very small gap at the joint portion 58 decided by the flatness of the transparent glass substrate 40 and the flatness of the glass substrate 42 can prevent the solvent for fritted glass from leaking toward the cell.

In order to better understand the feature of the present structure, it should be known that the portion where the spacer rib 7 is in contact with the glass substrate 1 in the conventional structure shown in FIG. 1 is sealed with a fritted glass. Since the porous spacer rib cannot maintain the hermetic state of the cell, the flatness of the top surface is lower than that of the glass substrate even if the spacer rib is made of a gas blocking substance, because the spacer rib is formed by stacking film substances. The portion may occur where the gap between the glass substrates 1 and the top surface of the rib becomes partially large. The portion with a large gap may introduce the fritted glass and the solvent into the discharge space. In contrast, the structure of the present embodiment does not have such a disadvantage.

In the structure shown in FIG. 2, the transparent substrate 40 is exposed at the portion where the top surface of the sealing wall 57 is in contact with the front plate 54. In this case, the gap at the joint portion 58 can be easily and uniformly maintained at a small value. The dielectric layer 46 may extend to the portion where the sealing wall 57 contacts. For example the dielectric layer 46 may be formed all over the surface of the transparent glass substrate 40. In this case, the substance of the dielectric layer 46 and the substance smoothing step are considered to secure the flatness of the surface of the dielectric layer 46.

According to the flat display panel of the present invention, the sealing wall, which is defined by sculpturing a substrate forming a back plate, is jointed to the front plate. The joint portion is sealed with a bonding agent. As a result, a high-reliability sealing effect can be obtained because of the very small gap at the joint portion and a bonding agent penetrating the joint portion. In the front plate, the protruding portion protruding out from the sealing wall joint surface prevents a bonding agent from protruding out from the end of the font plate, so that the boundary between the display surfaces of neighbor panels becomes inconspicuous. Moreover, since the small gap between the sealing wall and the front plate requires a small amount of bonding agent, the size of the protruding portion becomes small. Thus, the dead space not used for displaying is effectively reduced. Moreover, the small gap between the sealing wall and the front plate can effectively prevent the solvent for the bonding agent from penetrating into the discharge space.

Embodiment 2

Figure 3:
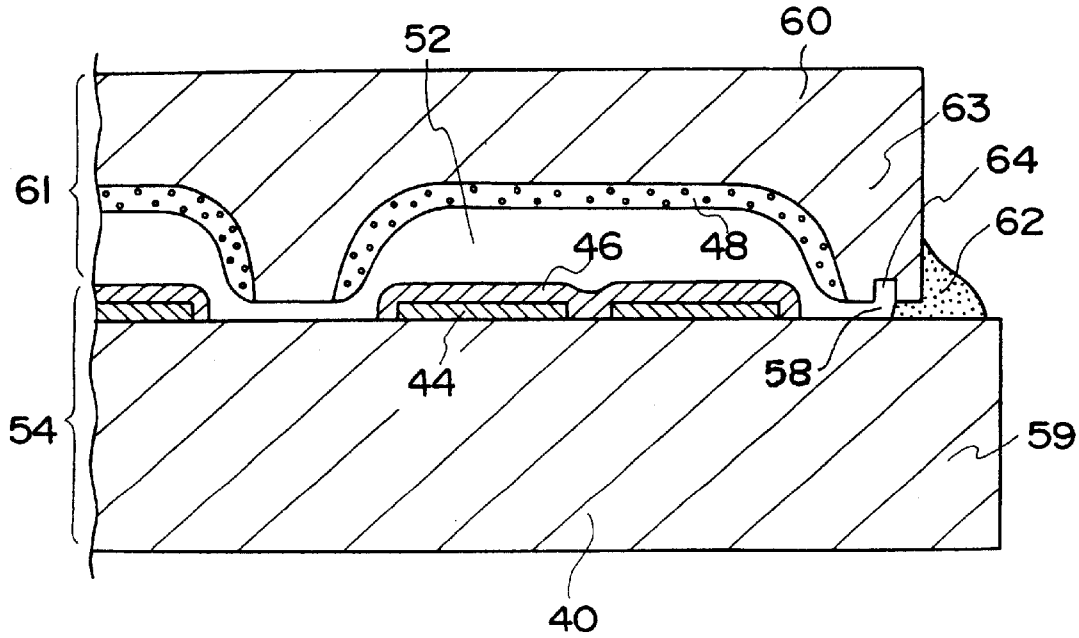
FIG. 3 is a cross-sectional view schematically illustrating the side end sealing structure of a novel flat display panel according to the second embodiment of the present invention.

FIG. 3 is a cross sectional view schematically illustrating the end portion of a flat display panel with a new structure according to the second embodiment of the present invention. In FIG. 3, for a brief description, like numerals represent the same constituent elements as those in the first embodiment.

The present structure differs from the structure in the above-mentioned embodiment in that a groove 64 is formed in the sealing wall 63 of the back plate 61 and along the sealing wall. The groove 64 is formed at the same time when the recessed portions 52 are formed in the glass substrate 60 in the sand-blasting step. The width of the groove 64 is for example, about 100 to 150 $\mu$m. Because the mask opening is small in the sand blasting step, the depth of the groove 64 is, for example, about 100 to 300 $\mu$m smaller than the depth (e.g. about 600 $\mu$m) of the recessed portion. The thickness of the sealing wall 63 is about 0.25 mm, as shown in the above-mentioned embodiment.

The back plate 61 including the glass substrate 60 with the groove 64 is placed over the front plate 54. Like the above-mentioned embodiment, the joint portion 58 between the sealing wall 63 and the front plate 54 is sealed with the fritted glass 62 deposited on the protruding portion 59. The groove 64 blocks the fritted glass invading the gap at the joint portion 58. In other words, the groove 64 prevents the fritted glass 62 from advancing through the joint portion 58 of the sealing wall 63 into the cell area. Thus, it can be avoided that the solvent for the fritted glass 62 pollutes the inside of the cell area.

In the structure, the groove 64 is formed in the back plate 61. This structure has the advantage that the groove 61 is formed at the same time in the sand blasting step, together with the recessed portions 52, and has another advantage that the front plate 54 is easily positioned with the back plate 61 by self-aligning the top surface of the sealing wall 63 with the groove 64. The structure where the groove 64 is formed in the top surface of the sealing wall 63 can be applied to the case where the portion of the transparent glass substrate 40 to which the sealing wall 63 adjoins is coated with the dielectric layer 46. The groove 64 may be formed in the portion of the transparent glass substrate 40 to which the sealing wall 63 adjoins. This structure requires another sand-blasting step but can prevent the fritted glass 62 from penetrating into the cell area.

According to the flat display panel of the present invention, the front plate or back plate has a groove along the sealing wall and at the joint portion between the sealing wall and the front plate. This structure can maintain at a moderate value the amount that a bonding agent deposited outside the joint portion penetrates. That is, the bonding agent may easily invade the groove but is difficult to invade the inner area over the groove. Hence the disadvantages that the bonding agent reaches the discharge space and that the solvent for the bonding agent contaminates the same can be eliminated while the reliability of sealing is maintained.

Embodiment 3

Figure 4:
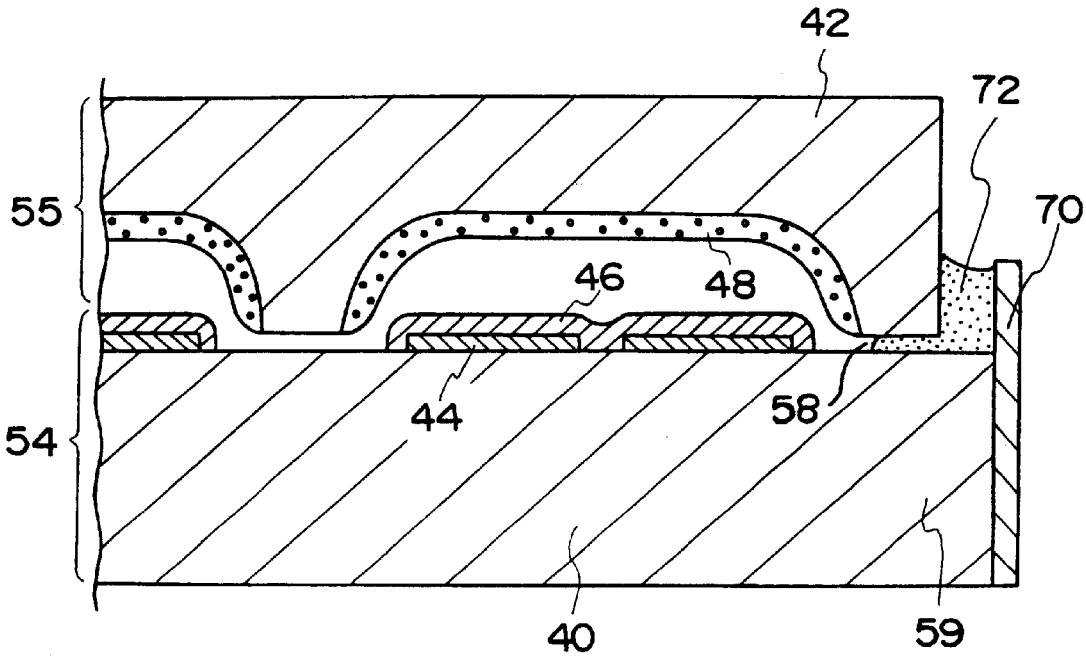
FIG. 4 is a cross-sectional view schematically illustrating the side end sealing structure of a novel flat display panel according to the third embodiment of the present invention.

FIG. 4 is a cross-sectional view schematically illustrating the end of a flat display panel according to the third embodiment of the present invention. Like numerals represent the same constituent elements as those in the above-mentioned embodiments, and so duplicate description will be omitted here.

The present structure differs from that in the first embodiment in that a barrier 70 of thin film glass is attached on the side surface of the protruding portion 59 of the transparent glass substrate 40 forming the front plate 54. The barrier 70 protrudes on the side where the fritted glass 72 for sealing the joint portion 58 is deposited. A ditch is defined by the side surface of the glass substrate 42, the top surface of the protruding portion of the transparent glass substrate 40, and the barrier 70 along the outside of the joint portion 58. The ditch is filled with the fritted glass 72.

The structure blocks the fritted glass spreading outward from the surface of the substrate. Thus, flat display panels can be arranged so as to abut the side end surfaces of the transparent glass substrates 40 on each other. This feature enables the joint between flat panel displays to be viewed seamlessly from the front side thereof.

Thus, even when the protruding portion 59 is made shorter, the fritted glass substrate 40 does not overflow from the end of the transparent glass substrate 40, so that the panel periphery space not effectively used as a display area is reduced.

Moreover, the fritted glass 72 is vertically filled between the barrier 70 and the side surface of the glass substrate 42, that is, in the direction of the thickness of the panel. Since the contact area where the fritted glass 72 comes into contact with the side surface of the glass substrate 42 and the barrier 70 can be expanded, a high reliability hermetic seal can be secured.

The flat display panel of the present invention has a barrier that blocks a bonding agent at the outer side surfaces of the front substrate. This barrier prevents the bonding agent sealing the joint portion defined between the front plate and the back plate from spreading outward from the outer side surfaces of the front plate. This structure has the advantage that since the gap between neighboring panels is small, the boundary on display panels becomes inconspicuous. Moreover, since the protruding portion of the front plate can be shortened, the dead space in displaying can be effectively reduced. The distance between the joint portion to be sealed with a bonding agent and the outer portion is extended by filling the space between the back plate and the barrier with a bonding agent. As a result, the hermetic reliability can be effectively improved.

Embodiment 4

Figure 5:
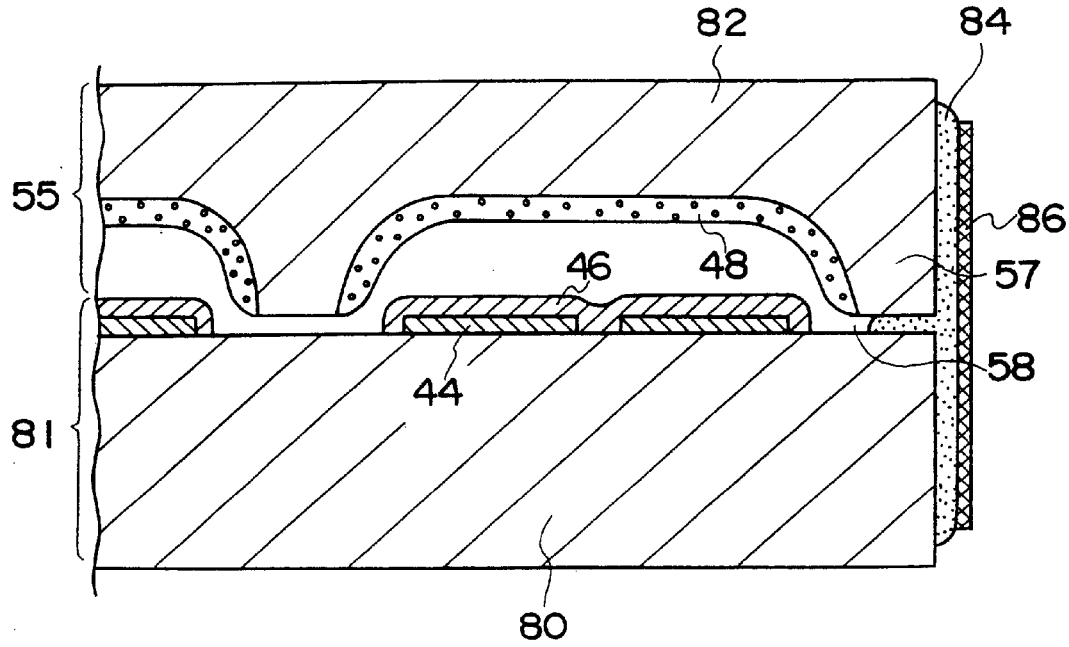
FIG. 5 is a cross-sectional view schematically illustrating the side end sealing structure of a novel flat display panel according to the fourth embodiment of the present invention.

FIG. 5 is a cross sectional view schematically illustrating the end of the side sealing portion of a flat display panel with a new structure according to the fourth embodiment of the present invention. In FIG. 5, in order to simplify the explanation, like numerals represent the same constituent elements as those in the above-mentioned embodiment.

The present structure differs from that in the first embodiment in that the front plate 81 includes the transparent glass substrate 80 and has no protruding portion 59 protruding from the back plate 55 (or the glass substrate 82). That is, the back plate 55 is placed over the front plate 81 while the end surface of the back plate 56 is substantially flush with that of the front plate 81. The fritted glass is deposited on the outer side of the joint portion 58 between the sealing wall 57 and the transparent glass substrate 80. A metal band 86 is placed over the fritted glass 84 under pressure and the fritted glass 84 is then calcinated.

The fritted glass 84 is squeezed along the side surface of the flat display panel by clamping the metal band 86. With such a condition sustained, the fritted glass is calcinated and solidified. Thus, the surface area of the fritted glass 84 exposed to air is reduced. The distance of the boundary between the side surface of the glass substrate 82 or the transparent glass substrate 80 and the surface of the fritted glass 84 becomes long, ranging from the end where the fritted glass is exposed to air to the joint portion 58. Hence, the cell area can be hermetically sealed with high reliability.

The metal band 86 clamps the fritted glass 84 to prevent it from bulging in the direction of the panel main surface. This means that the gap between neighbor display panels can be reduced. The advantage is that the seam between panels is unobtrusively viewed from the main panel surface and that the waste area not used as a display area can be reduced.

The metal band 86 is basically wounded over the whole side surface of the flat display panel. The metal band 86 may be formed of strips attached to the sides of the flat display panel and each having a length corresponding to that of each of the sides thereof. The metal band 86 may be formed of two L-shaped metal plates disposed so as to surround the flat display panel. Each L-shaped metal plate may be formed of strips previously jointed and corresponding to two neighboring sides. The metal band 86 may be a rectangular metal frame fitting the outer shape of the flat display panel. The superposed structure of the front plate 81 and the back plate 55 may be inserted into the rectangular frame.

In order to narrow the gap between panels, it is desirable that the thickness of the metal band 86 is as thin as possible. By factoring the thinning and the mechanical strength, the metal band 86 has a thickness of 0.1 to 0.2 mm. The glass substrates 80 and 82 will expand and contract in the step of calcinating the fritted glass 84 or due to changes in temperature of the flat display panel in use. In order to deal with such a problem, the metal band 86 is of a material with a thermal expansion coefficient close to that of the glass material. The use of such a material can prevent occurrence of stress due to differences in thermal expansion or contraction between the glass substrate 82 and the metal band 86, and peeling of the metal band 86 due to the stress, and sealing degradation due to the peeling. For example, 50 NiFe (with a linear expansion coefficient of $94\times10^{-7}$ $deg^{-1}$) is used for a soda glass substrate (with a linear expansion coefficient of $85\times10^{7}$ $deg^{-1}$). Tungsten (W) (with a linear expansion coefficient of $46\times10^{7}$ $deg^{1}$) or molybdenum (M) (with a linear expansion coefficient of $51\times10^{-7}$ $deg^{1}$) or 29 NiFeCo (kover) (with a linear expansion coefficient of $45\times10^{-7}$ $deg^{-1}$) is used for a non-alkali glass substrate (with a linear expansion coefficient of 45 to $50\times10^{-7}$ $deg^{-1}$).

In the flat display panel according to the present invention, a band member is rolled over the bonding agent deposited at the joint portion between the front plate and the back plate. The band member spreads the bonding agent over the side surface of a flat display panel. Thus, the surface area that the bonding agent has exposed to the air is reduced. Moreover, the distance between the outside air and the joint portion between the front plate and the back plate and over which the bonding area is sealed with the bonding agent is made longer, so that the cell area can be hermetically sealed with high reliability. The band member rolls the bonding agent layer, thus preventing the bonding agent from bulging in the direction of the main panel surface. The gap between neighbor display panels can be narrowed so that the boundary between display panels becomes inconspicuous. The dead space in displaying can be reduced due to no protruding portion.

What is claimed is:

1. A flat panel display comprising:

a front panel of a transparent glass substrate on which cell electrode pairs are arranged for pixels; and a back plate having recessed portions formed in a surface thereof, said recessed portions being positioned so as to confront said cell electrode pairs, said recessed portions each defining a discharge space, said back plate being placed over said front plate;

said back plate having a sealing wall having a top surface of said back plate remaining outside a display region formed of said recessed portions;

wherein a contact portion between said sealing wall and said front plate is sealed by means of a bonding agent layer to be bonded on the outer side surface of a superposed structure of said front plate and said back plate as well as a band member to be securely bonded on said outer side surface of said superposed structure are pressure-bonded to said bonding agent layer.

2. A flat panel display device, comprising:

a front plate of a transparent glass substrate on which cell electrode pairs are arranged for pixels of the display; and a back plate having recessed portions formed in a surface thereof, said recessed portions being positioned so as to confront said cell electrode pairs, said recessed portions each defining a discharge space, said back plate being placed over said front plate;

said back plate having a sealing wall formed at peripheral edges thereof, with a top surface of the sealing wall portion of said back plate being sufficiently close to the surface of said front plate on which said cell electrode pairs are arranged when the two plates are brought together in a confronting relationship that a gap is formed between said sealing wall and said front plate surface;

said front plate having a protrusion protruding outward from an outer end of said sealing wall;

wherein said gap between said sealing wall and said front plate surface is sealed by depositing a bonding agent in a corner portion defined by the outer side surface of said sealing wall and said protrusion of said front plate, said corner portion being adjacent to said sealing wall portion; and further comprising a barrier for blocking said bonding agent on the outer end portion of said front plate.

* * * * *